United States Patent [19]

Nelson

[11] Patent Number: 4,878,458

[45] Date of Patent: Nov. 7, 1989

[54] METHOD AND APPARATUS FOR GENERATING PRESSURIZED FLUID

[76] Inventor: Clinton D. Nelson, 2910 Frontenac, North Chicago, Ill. 60606

[21] Appl. No.: 91,505

[22] Filed: Aug. 31, 1987

[51] Int. Cl.[4] ..... F22B 5/02

[52] U.S. Cl. ..... 122/4 A; 122/13 A; 219/311

[58] Field of Search ..... 122/4 A, 13 A; 23/304 R, 304 C; 219/311, 272, 275, 271

[56] References Cited

U.S. PATENT DOCUMENTS

| | | | |
|---|---|---|---|
| 2,785,272 | 3/1957 | Baly | 219/311 X |
| 3,279,379 | 10/1966 | Klyce | 73/304 R |
| 4,056,978 | 11/1977 | Zimmermann | 73/304 R |
| 4,287,407 | 9/1981 | Treiber et al. | 219/273 |
| 4,333,626 | 6/1982 | Holbrook | 219/311 X |
| 4,480,173 | 10/1984 | Butterfield | 122/4 A X |
| 4,601,263 | 7/1986 | Shieh | 122/13 A |

*Primary Examiner*—Edward G. Favors

*Attorney, Agent, or Firm*—Niro, Scavone, Haller & Niro

[57] ABSTRACT

The invention is directed to a method and apparatus for generating fluids such as steam at elevated temperatures and pressures. The invention includes at least one or, alternatively, a plurality of interconnected tanks which are capable of holding fluids at elevated temperatures and pressures. At least one tank is heated externally and includes an improved heat exchanger for efficiently carrying out heating of the tank. The invention includes a fluid level sensor for sensing the level of liquid in the tank, whereby the sensor deactivates heating of the tank when the level of fluid in the apparatus drops below a preselected level.

14 Claims, 3 Drawing Sheets

45
60
40
10
50
30
55
80
35
65
15
25
75
70
20
210

35
325
350
40
350
315
315

300
30
80
65
210
45
60
15
25
20
50
55
75
70

METHOD AND APPARATUS FOR GENERATING PRESSURIZED FLUID

FIELD OF THE INVENTION

The present invention generally relates to devices and methods for generating pressurized fluid and more specifically to devices and methods for steam cleaning, particularly metallic objects which include metals such as gold, brass and silver.

BACKGROUND OF THE INVENTION

Steam cleaning machines have been employed to clean and shine metal objects and parts including gold, brass, silver and other metal objects. As such, these machines have found widespread application for cleaning and polishing of jewelry made of brass, gold, silver, and other metals. However, the prior art machines have suffered from high maintenance costs and high energy consumption. In addition, the prior art machines have lacked the capability for effectively and efficiently controlling the heat and pressure applied to the item of jewelry to effectuate cleaning. Further, the prior art devices have lacked an efficient heat exchanging device for steam cleaning machines. A need therefore exists for a low maintenance, cost efficient, high-quality steam cleaning system which is energy efficient and is capable of controlling the heat and pressure applied to the object being cleaned.

SUMMARY OF THE INVENTION

The invention is directed to an apparatus and method for generating fluids such as steam at elevated temperatures and pressures. The apparatus of the present invention includes at least one or, alternatively, a plurality of, interconnected tanks which are capable of holding fluids at elevated temperatures and pressures. These tanks are closeable and one of the tanks is provided with an inlet valve for permitting the tank to receive liquid therein. An air relief or bleed valve is associated with the one tank for selected releasing and/or bleeding air pressure from the tank which may be developed by heating the liquid in the tank. The one tank is also provided with an external heater to heat the liquid in the tank to elevated temperatures and pressures. The temperature of the liquid is controlled by a temperature control device that includes a thermostat mounted on the tank for sensing the temperature of the tank and a control circuit associated with the thermostat for controlling the temperature of the heater. In addition, a heat sink may be provided between the tanks to connect a second tank and facilitate convection heating of such an additional tank. Additional tanks may also be added by adjusting the size of the heat sink provided.

The apparatus further includes a fluid level sensor for sensing the level of liquid in the tank, whereby the sensor deactivates the external heater when the level of fluid in the tank drops below a preselected level.

The fluid level sensor includes first and second metallic sensors contained in an insulative material which are capable of detecting the fluid level in the tank when positioned in a suitable housing suitable for insertion into the tank. The pressurized, high temperature fluid which is generated by the apparatus is controllably removed therefrom by means of a solenoid valve which may be electrically or mechanically actuated.

THe invention is also directed to a method of generating pressurized fluid at elevated temperatures. The method entails housing the fluid in a tank, externally heating the tank and the fluid housed in the tank to elevated temperatures and pressures and sensing the level of fluid in the tank. The external heating of the tank and fluid is controlled within a predetermined range to efficiently provide fluid at elevated temperatures and pressures.

DETAILED DESCRIPTION OF THE PREFERRED EMBODIMENTS

The cleaning apparatus of the invention and its use in cleaning and treating metallic components such as jewelry will now be explained in detail by reference to the drawings wherein like numerals refer to like components. A one tank cleaning apparatus according to the invention is generally shown at 10 in FIG. 1. The one tank apparatus includes a tank 15 of stainless steel or similar corrosion resistant metal. Preferably, tank 15 is sufficiently strong so as to be capable of withstanding pressures of at least within the range of about 80 pounds per square inch to about 100 pounds per square inch.

Heating element 20 and heat exchanger 25 are mounted on the external surface of tank 15. Locating heating element 20 on the external surface of tank 15 provides for rapid heat transfer to the liquid within the tank as the complete surface area of the tank contacts and heats the water, and also reduces maintenance by eliminating the possibility of lime deposits that tend to form on heating elements which are immersed in water.

Figure 3:
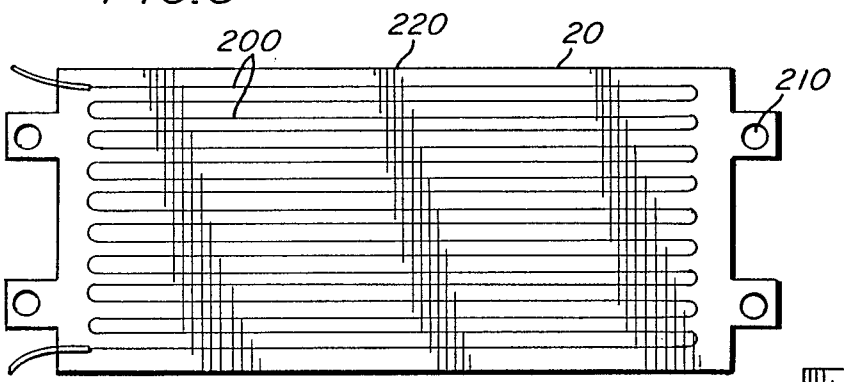
FIG. 3 is a top view of the heating element employed in the apparatus of the invention.

Heating element 20, as illustrated in greater detail in FIG. 3, includes a plurality of heating coils 200 which are joined together on flexible frame 220. The heating element is held in place on the external surface to the tank by, for example, bolt-nut connections 210. Heating element 20 is preferably located near the bottom portion of tank 15 to insure uniform heating of the liquid contained in the apparatus. Any type of heating coil 200 may be included in heating element 20. However, conventional nickelchrome electrical coils 20 are preferred since they provide rapid, efficient, controllable heating of tank 15.

Figure 4:
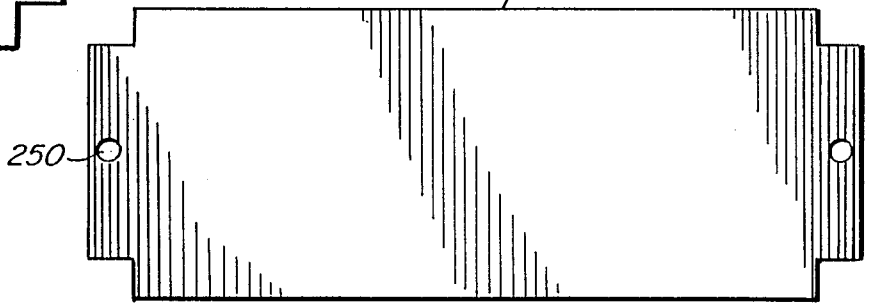
FIG. 4 is a top view of the heat exchanger employed in the apparatus of the invention.

Heat exchanger 25 is also mounted on the external surface of tank 15 in a position adjacent to and above heating element 20. As illustrated in FIG. 4, heat exchanger 25 is comprised of a flexible, high conductivity metal. Such metals include, but are not limited to aluminum, copper and the like. Heat exchanger 25 is held in place on the surface of tank 15 by use of bolt-nut connectors 250.

In using the apparatus to treat components such as jewelry, liquids such as distilled water or tap water are deposited in tank 15 via inlet valve 45. Inlet valve 45 can include a globe valve, ball value, or other equivalent valves, as would be recognized by those skilled in the art. Air pressure developed in tank 15 during filling thereof is released by means of air release valve 35. Valve 35 also serves as an exit for overflow due to overfilling the tank with liquid.

Figure 5:
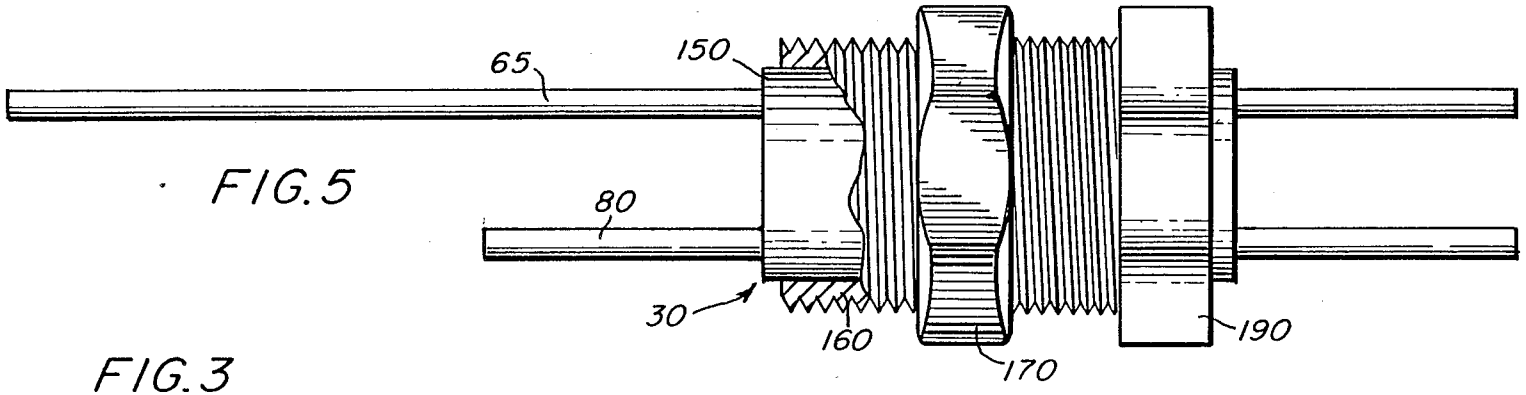
FIG. 5 is a side view of a fluid sensing device for monitoring of the liquid level in the tanks of the apparatus of the present invention.

Heating of tank 15 by heating element 20 is initially controlled by fluid level sensor 30. Sensor 30 controls heating element 25 in that sensor 30 will deactivate heating element 25 if the liquid level in tank 15 is below a predetermined amount. As shown in detail in FIG. 5, sensor 30 includes unequal length sensors depicted as rods 65 and 80, which may be adjustably positioned within insulator 150. Threaded rings 160 are provided about insulator 150 for threaded engagement with the topmost surface of tank 15. Hex ring 170 is provided about insulator 150 to assist in the threaded engagement of sensor 30 with tank 15. Compression ring 190 is provided about insulator 150 for retaining rods 65 and 80 in their respective positions within insulator 150.

During heating of tank 15, if the level of liquid therein drops below the end of rod 65, then sensor 30 will send an electrical signal to thermostat 70 to deactivate heating element 25. As such, this reduces overall maintenance by preventing overheating and possible burnout of heating element 25. However, although heating element 25 will have been deactivated, any high pressure, high temperature fluid such as steam remaining in the apparatus will remain available for use. Similarly, if the level of liquid, after activation of main power to the unit, is between rod 65 and 80, that is if the level falls below rod 80, but is still in contact with rod 65, the sensor will send an electrical signal to thermostat 70 to continue providing power to heating element 25. This condition is maintained until the main power to the unit is deactivated or turned off. If the main power is turned off and reactivated before the water level is brought back to a level where it contacts both rods 65 and 80, sensor 30 will not allow power to be directed to the heating unit. Thus, sensor 30 provides the means for controlling and monitoring the level of liquid within tank 15 during both the initial filling of tank 15 as well as operation thereof. Moreover, sensor 30 provides the capability for pre-selecting the level of liquid at which heating element 25 will be deactivated by varying the lengths of rods 65 and 80.

After filling tank 15 with liquid through inlet valve 45 to an acceptable level, as determined by sensor 30, heating element 20 is energized to heat the liquid in tank 15. The filled condition is also indicated by illumination of a light (not shown) on the panel of the steam cleaning unit. The fluid in the tank is heated to a temperature sufficient to generate, for example, steam at a pressure of about 45 to about 65 pounds per square inch. It should be noted that the unit is operable to generate steam when the pressure within the tank is about 0 to about 70 pounds per square inch.

The temperature of the liquid in tank 15 is controlled by means of a temperature control system that includes heat exchanger 25, thermostat 75 and control unit 70. In this aspect, heat is transferred from tank 15 via heat exchanger 25 to thermostat 75. Thermostat 75 provides a signal to control unit 70 to adjust the amount of energy flowing to heating element 25 to thereby maintain the liquid within tank 15 at a desired temperature and pressure. Excess pressure, as determined for example, by a conventional pressure gauge (not shown), which may be included on the front panel of the unit, may be released through high pressure release valve 40. High pressure relief valve 40 begins to open when the pressure in tank 15 exceeds 100 pounds per square inch.

Heat exchanger 25 is positioned above and in contact with heating element 20 to provide efficient and substantially complete radiation of the heat generated by heating element 20 into and through tank 15. This provides a substantially improved heating efficiency while substantially reducing the time and energy necessary to heat the fluid in tank 15 and generate steam therefrom. Heat exchanger 25 is preferably constructed of aluminum. However, heat exchanger 25 can be constructed of a variety of conducting metals including, but not limited to, stainless steel, copper, and the like.

After the liquid in tank 15 has been heated to a temperature sufficient to generate steam at the desired pressure, components such as jewelry may be cleaned and shined by subjecting them to bursts of steam. This is accomplished by switch 60 which activates electrical solenoid valve 50, whereby steam is released at outlet 55 to treat the components. Solenoid valve 50 may be activated through electrical or mechanical actuation. Preferably, such activation is electrical.

Outlet 55 may include a variety of configurations which accomplish its ultimate purpose of directing a fine spray of steam from tank 15. In order to accomplish such spraying, outlet 55 includes a venturi therein to create and disperse this predetermined spray configuration. It should be noted that all of the mechanical and plumbing fittings including pipes, connectors and the like are preferably manufactured from materials which will not rust. This provides a unit having increase longevity and efficiency. Such materials include, but are not limited to, brass, copper, stainless steel and the like. Furthermore, it is most desirable to manufacture solenoid valve 50 out of stainless steel. It has been determined that brass, which contains zinc, develops incomplete sealing over long periods of use at the pressures and temperatures indicated above.

Figure 1:
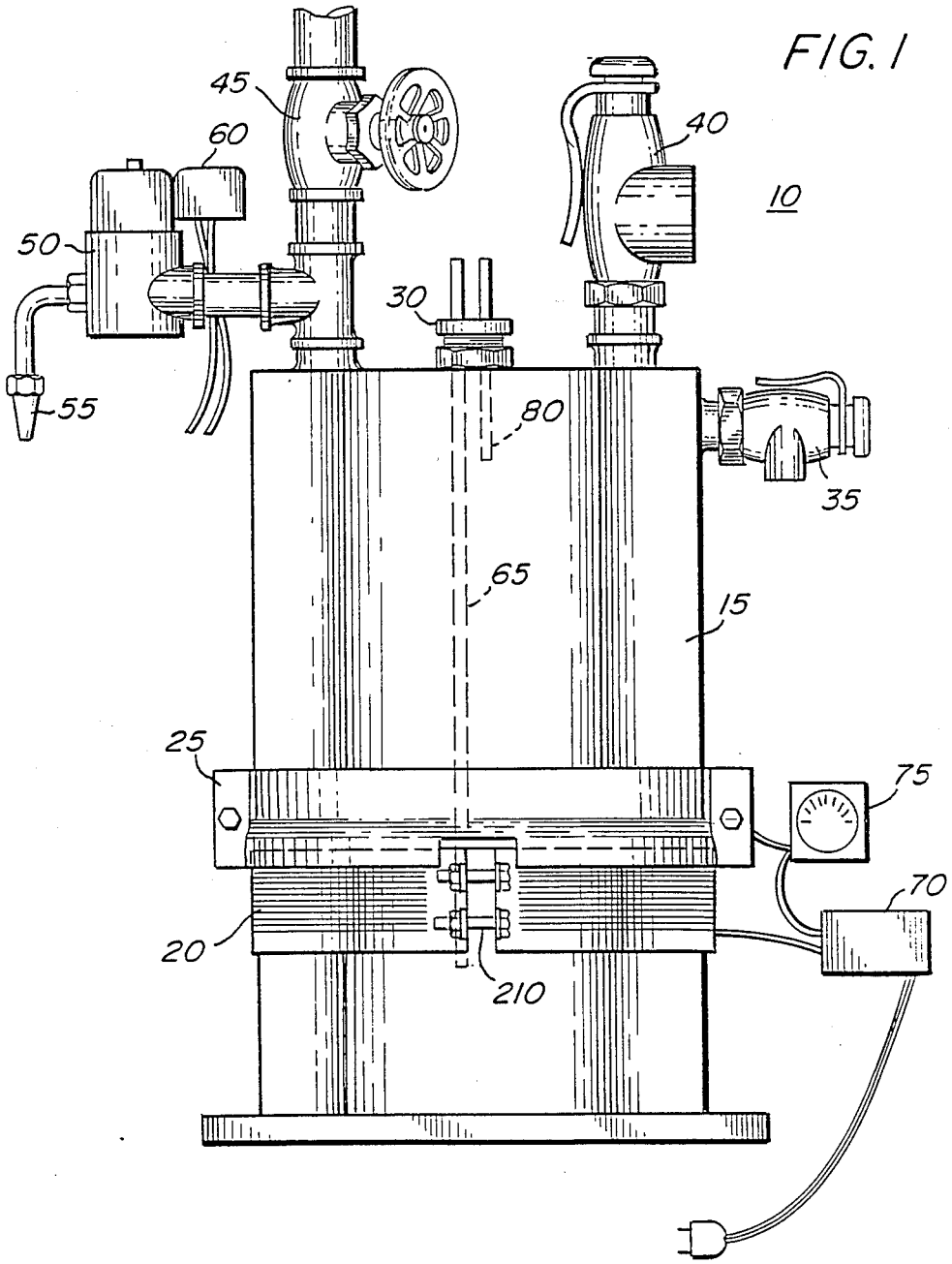
FIG. 1 is a side view of a one tank apparatus constructed according to the present invention.
Figure 2:
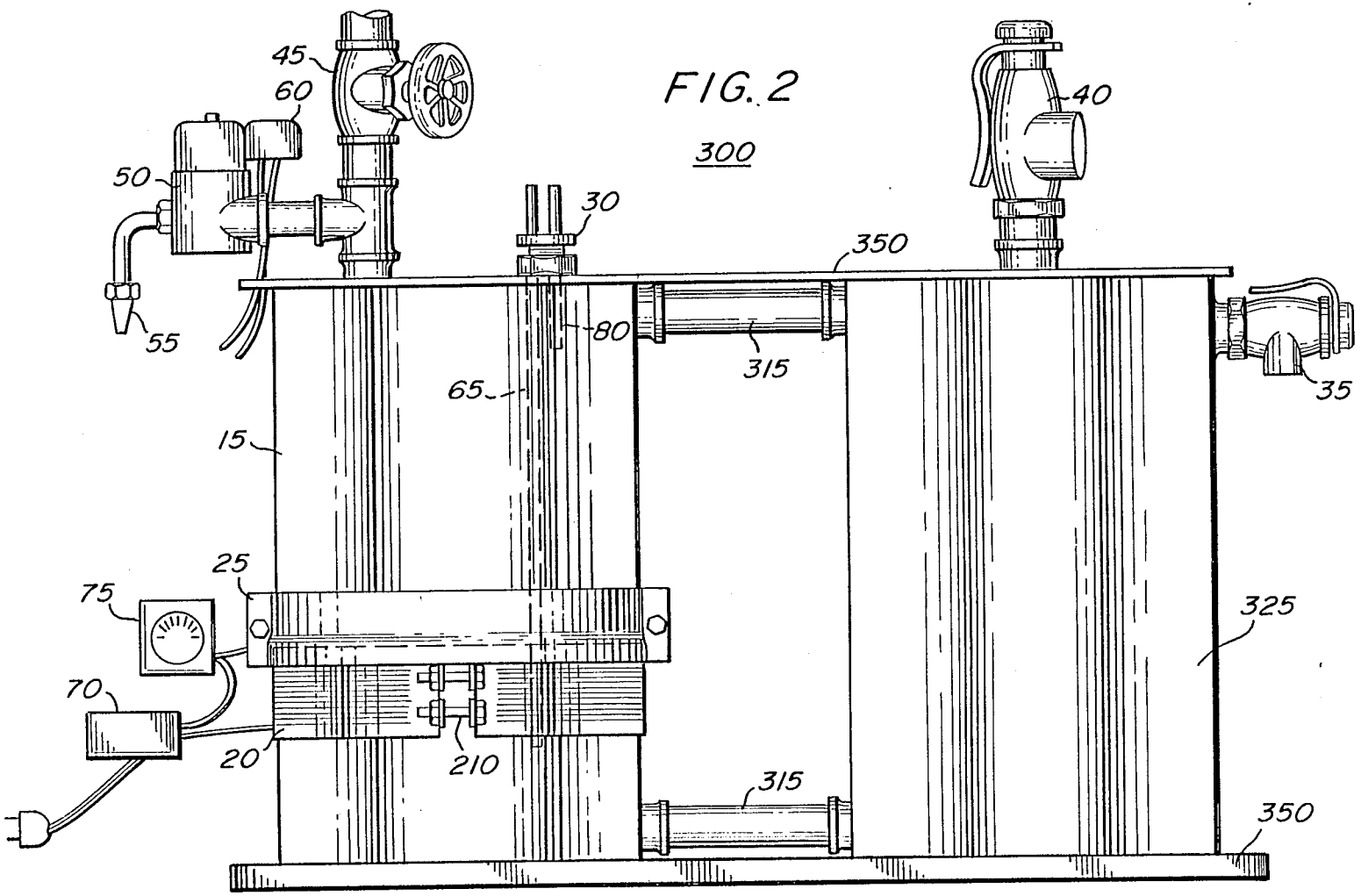
FIG. 2 is a side view of a two tank apparatus constructed according to the present invention.

A multi-tank apparatus according to the invention wherein at least two tanks are employed is shown in FIG. 2. The apparatus shown in FIG. 2 is similar to the one tank apparatus of FIG. 1 except that one or more additional tanks 325 are connected to tank 15 by connectors 315. In addition, heat sink 350 is provided between the tanks to increase the rate of heating of tank 325. Air relief valve 35 and high pressure release valve 40 can be relocated to tank 325. The multi-tank apparatus of FIG. 2 therefore has additional capacity beyond that of the one tank apparatus of FIG. 1, while maintaining all of the features and advantages described above for the one tank apparatus.

Filling of the multi-tank apparatus with liquids such as tap water or distilled water is similar to that of the one tank apparatus shown in FIG. 1. As liquid is supplied to tank 15 via inlet valve 45, liquid is supplied to tank 325 by connection 315 whereby the level of liquid in tank 325 rises to the same level as in tank 15. Filling of tank 15 is continued to provide a level of liquid that is above the bottom of rod 65 but below the bottom of rod 80. Operation of the multi-tank apparatus to generate steam at sufficient temperature and pressure to clean and polish components such as gold, silver and brass is accomplished in substantially the same manner as described above regarding the one tank apparatus.

In performing the method or process of generating pressurized fluid of the present invention, a fluid is housed in one or more tanks, such as tanks 15 and 325. At least one of the tanks is externally heated to heat the fluid housed in the tank to elevated pressures and temperatures. The fluid level in at least one tank is sensed and the external heating of the tank and fluid is controlled within at least one predetermined range to efficiently provide fluid at elevated temperatures and pressures. The process may also include controllably removing heated fluid from the tank. In the instance where more than one tank is provided, the tank that is externally heated becomes the heat source by which the additional tanks and the fluid in those tanks is heated.

Externally heating the tank controls the temperature of the tank and the fluid within the tank to at least about 212° F. External heating of the tank also controls the pressure within the tank to be in the range of about 0 pounds per square inch to about 70 pounds per square inch and more preferably within the range of about 40 pounds per square inch to about 65 pounds per square inch.

The inventive process wherein metal components are cleaned by use of the apparatus of the present invention will now be explained by reference to the following, non-limiting examples. Example 1:

A gold ring is ultrasonically cleaned to loosen and partially remove dirt and tarnish from the metal. Thereafter, the ring is subjected to a series of bursts of steam at a temperature in excess of 212° F., and a pressure of between 45 pounds per square inch to 65 pounds per square inch to remove any residual oxidation, soil deposits, and the like from the metal. Example 2:

A silver ring is ultrasonically cleaned to loosen and partially remove dirt and tarnish from the metal. Thereafter, the ring is subjected to a series of bursts of steam at a temperature of at least 212° F., and a pressure of at least 45 pounds per square inch to remove any residual oxidation from the metal.

Although the above examples have been described with reference to precious metals, it should be noted that various other metals including, but not limited to, brass, copper, stainless steel, and the like may be treated according to the above process. Accordingly, it should be understood that the apparatus and method of the present invention can be employed to process a wide range of components and materials.

What is claimed is:

1. An apparatus for generating pressurized fluid at elevated temperatures, said apparatus comprising:

a plurality of tanks housing fluids at elevated temperatures and pressures;

heating means for externally heating at least one tank and heating the fluid housed in said at least one tank to elevated temperatures and pressures;

heat sink means provided between each of said plurality of tanks to transfer heat from said at least one externally heated tank to the other said plurality of tanks;

temperature control means for controlling said heating means to heat the fluid housed in said at least one tank to temperatures sufficient for providing fluids at elevated temperatures and pressures; and fluid level sensing means for sensing the level of fluid in said at least one tank and deactivating said heating means when the level of fluid in said tank is below a preselected amount.

2. The apparatus of claim 1 further including a pressure gauge attached to at least one of said tanks for monitoring the fluid pressure in at least said one tank.

3. The apparatus of claim 1 further including valve means to controllably remove fluid heated to elevated temperatures and pressures by said external heating means.

4. The apparatus of claim 1 wherein said temperature control means includes a heat exchanger and a thermostat mounted on said at least one tank for sensing the temperature of said at least one tank; and a control circuit associated with said thermostat for controlling the temperature of said heating means.

5. The apparatus of claim 4 wherein said heat exchanger is constructed form aluminum and is in contact with said external heating means to provide efficient radiation of heat into said at least one tank to heat the fluid housed therein.

6. An apparatus for generating pressurized fluid at elevated temperatures, said apparatus comprising:

a plurality of closeable, interconnected tanks capable of holding fluids at elevated temperatures and pressures such that said fluids may flow between said tanks;

an inlet valve associated with one of said tanks for permitting said one of said plurality of tanks to receive fluid therein;

an air bleed valve associated with one of said tanks for removal of air pressure generated in said plurality of tanks caused by filling of said plurality of tanks with fluid through said inlet valve;

heating means for externally heating one tank of said plurality of tanks and to heat the fluid provided in said plurality of tanks to elevated temperatures and pressures;

a heat sink provided between each of said plurality of tanks to transfer heat from said one externally heated tank to the other said plurality of tanks;

temperature control means for controlling said heating means to heat the fluid provided in said plurality of tanks to temperatures sufficient for providing fluids at elevated temperatures and pressures;

fluid level sensing means for sensing the level of fluid in at least one of said plurality of tanks, said sensing means deactivating said heating means when the level of fluid in said plurality of tanks is less than a preselected amount; and a solenoid valve to controllably remove fluid heated to elevated temperatures and pressures from said plurality of tanks.

7. The apparatus of claim 6, further including a pressure gauge attached to at least one of said tanks for monitoring the fluid pressure in said at least one of tanks.

8. The apparatus of claim 6, wherein said temperature control means includes a thermostat mounted on at least one of said tanks for sensing the temperature thereof; and a control circuit associated with said thermostat for controlling the temperature of said heating means.

9. The apparatus of claim 8 wherein said heating means includes a heating element and a heat exchanger constructed of aluminum in contact with said external heating element to provide efficient radiation of heat into said at least one tank to heat the fluid housed therein.

10. A method of generating pressurized fluid comprising the steps of:

housing a fluid in at least two associated tanks;

externally heating one of said tanks such that said one tank becomes the heat source to heat the fluid within said one tank;

transferring the heat from said one tank to a second of said tanks through heat sink means connected there between to heat the fluid within said second tank;

sensing the level of said fluid in said one tank; and controlling the external heating said one tank and said fluid to efficiently provide fluid at elevated pressures.

11. The method of claim 10 including the step of controlling the pressure within at least said one tank within a predetermined pressure range.

12. The method of claim 11 wherein the step of controlling the pressure within said one tank includes controlling the pressure within at least said one tank to be in the range of about 0 pounds per square inch to about 70 pounds per square inch.

13. The method of claim 11 wherein the step of controlling the pressure with said one tank includes controlling the pressure within at least said one tank to be in the range of about 40 pounds per square inch to about 65 pounds per square inch.

14. A method of generating pressurized fluid comprising:

housing fluid in at least two associated tanks;

externally heating one of said tanks such that said one tank becomes the heat source to heat the fluid within said one tank;

exchanging the heat from said one tank to a second of said tanks to heat the fluid within said second tank;

sensing the level of said fluid in said one tank;

controlling the external heating of said one tank and said fluid to efficiently provide fluid at elevated temperatures; and controlling the pressure within at least one of said tanks to be within the range of about 40 pounds per square inch to about 65 pounds per square inch.

* * * * *